US010174464B2

(12) United States Patent
Thompson

(10) Patent No.: US 10,174,464 B2
(45) Date of Patent: Jan. 8, 2019

(54) GROUND CONTOURING APPARATUS

(71) Applicant: Horace A. Thompson, Okabena, MN (US)

(72) Inventor: Horace A. Thompson, Okabena, MN (US)

( * ) Notice: Subject to any disclaimer, the term of this patent is extended or adjusted under 35 U.S.C. 154(b) by 0 days.

(21) Appl. No.: 15/183,854

(22) Filed: Jun. 16, 2016

(65) Prior Publication Data

US 2017/0362781 A1 Dec. 21, 2017

(51) Int. Cl.

| | |
|---|---|
| ***E01C 19/23*** | (2006.01) |
| ***E01C 19/25*** | (2006.01) |
| ***E01C 23/08*** | (2006.01) |
| ***E01C 23/082*** | (2006.01) |

(52) U.S. Cl.

CPC ..... *E01C 19/236* (2013.01); *E01C 19/25* (2013.01); *E01C 23/082* (2013.01)

(58) Field of Classification Search

CPC ..... E01C 19/236; E01C 19/25; E01C 19/23; E01C 19/43; E01C 19/264; E01C 19/004; E01C 21/00; E02D 2200/16; E02D 2200/165; E02D 3/026; E02D 3/039; E02D 3/046; E02D 3/0265; E02D 3/02; E02F 9/2271; E02F 9/22; E02F 3/815; E02F 3/961; E02F 3/967; E02F 3/963; E02F 3/032

See application file for complete search history.

(56) References Cited

U.S. PATENT DOCUMENTS

| | | | | |
|---|---|---|---|---|
| 324,166 A * | 8/1885 | Riordan | E01C 19/236 172/351 |
| 1,043,239 A * | 11/1912 | Lee | E01C 19/236 404/124 |
| 1,225,547 A | 5/1917 | Willson | |
| 1,724,363 A | 8/1929 | Reed | |
| 1,790,758 A | 2/1931 | Montano | |
| 1,818,887 A | 8/1931 | Fairley | |
| 2,261,893 A * | 11/1941 | Wolfard | A01B 29/04 172/532 |

(Continued)

FOREIGN PATENT DOCUMENTS

EP 1231040 8/2002

OTHER PUBLICATIONS

PCT/US/2017/036980, Written Opinion of the International Searching Authority, dated Aug. 16, 2017, 6 pages.

*Primary Examiner* — Abigail A Risic
(74) *Attorney, Agent, or Firm* — Jeffrey A. Proehl; Woods, Fuller, Shultz & Smith, PC

(57) ABSTRACT

An apparatus for contouring particulate material may include a frame and at least one drum rotatably mounted on the frame such that the drum rotates substantially freely with respect to the frame about a central longitudinal axis. The drum may have opposite inboard and outboard ends and an outer surface therebetween. At least one blade may extend about the drum and protrude outwardly from the outer surface of the drum, and the blade may have an outer edge with a radius measured from the central longitudinal axis in a plane oriented in perpendicular to the central longitudinal axis of the drum to the outer edge. The outer edge of the blade may have a helical shape and the radius of the outer edge may be less at the outboard end of the drum than the radius of the outer edge at the inboard end of the drum.

20 Claims, 5 Drawing Sheets

(56) References Cited

U.S. PATENT DOCUMENTS

| | | | | | |
|---|---|---|---|---|---|
| 2,582,199 | A * | 1/1952 | Gardner | E01C 19/236 | 172/547 |
| 2,691,927 | A * | 10/1954 | Denton | A01B 33/021 | 172/115 |
| 3,202,221 | A | 8/1965 | Monk | | |
| 3,477,514 | A | 11/1969 | Woitas | | |
| 3,658,135 | A | 4/1972 | Thompson | | |
| 4,793,732 | A | 12/1988 | Jordon | | |
| 4,817,728 | A | 4/1989 | Schmid | | |
| 5,197,820 | A | 3/1993 | Skibsted | | |
| 5,199,195 | A | 4/1993 | Scordilis | | |
| 5,353,529 | A | 10/1994 | McCullough | | |
| 5,795,096 | A | 8/1998 | Culver | | |
| 5,864,970 | A | 2/1999 | Maddock | | |
| 5,967,242 | A * | 10/1999 | Caron | E02D 3/026 | 172/508 |
| 7,568,331 | B2 * | 8/2009 | Reichen | A01D 75/306 | 56/14.9 |
| 7,805,865 | B2 * | 10/2010 | Paske | E01C 19/286 | 37/403 |
| 8,550,745 | B2 * | 10/2013 | Thompson | E02D 3/039 | 172/518 |
| 8,695,721 | B2 * | 4/2014 | Phely | A01B 29/043 | 152/209.12 |
| 2007/0289755 | A1 | 12/2007 | Dowse | | |
| 2008/0069639 | A1 | 3/2008 | James | | |
| 2014/0147207 | A1 | 5/2014 | Parsons | | |

* cited by examiner

GROUND CONTOURING APPARATUS

BACKGROUND

Field

The present disclosure relates to earth moving contouring apparatus and more particularly pertains to a new ground contouring apparatus for maintaining a ground surface, such as a road surface.

SUMMARY

In one aspect, the present disclosure relates to an apparatus for contouring particulate material on a ground surface. The apparatus may have a centerline corresponding to an axis along which the apparatus is moved for contouring. The apparatus may comprise a frame extending laterally with respect to the centerline, and at least one drum rotatably mounted on the frame such that the drum rotates substantially freely with respect to the frame about a central longitudinal axis of the drum. The at least one drum may have opposite inboard and outboard ends and an outer surface therebetween. At least one blade may extend about the drum and protrude outwardly from the outer surface of the drum. The at least one blade may have an outer edge with a radius measured from the central longitudinal axis in a plane oriented in perpendicular to the central longitudinal axis of the drum to the outer edge. The outer edge of the at least one blade may have a helical shape and the radius of the outer edge may be less at the outboard end of the drum than the radius of the outer edge at the inboard end of the drum.

In another aspect, the disclosure relates to a system for contouring a road surface which may include a vehicle and an apparatus for contouring particulate material on the road surface. The apparatus may have a centerline corresponding to an axis along which the apparatus is moved for contouring. The apparatus may comprise a frame extending laterally with respect to the centerline, and a pair of drums rotatably mounted on the frame such that the drums rotate substantially freely with respect to the frame about a central longitudinal axis. Each of the drums may have opposite inboard and outboard ends and an outer surface therebetween. A plurality of blades may each extend about each of the drums. The blades each have an outer edge with a radius measured from the central longitudinal axis in a plane oriented in perpendicular to the central longitudinal axis of the respective drum to the outer edge. The outer edge of each of the blades may have a helical shape and the radius of the outer edge is less at the outboard end of the drum than the radius of the outer edge at the inboard end of the drum.

There has thus been outlined, rather broadly, some of the more important elements of the disclosure in order that the detailed description thereof that follows may be better understood, and in order that the present contribution to the art may be better appreciated. There are additional elements of the disclosure that will be described hereinafter and which will form the subject matter of the claims appended hereto.

In this respect, before explaining at least one embodiment or implementation in greater detail, it is to be understood that the scope of the disclosure is not limited in its application to the details of construction and to the arrangements of the components set forth in the following description or illustrated in the drawings. The disclosure is capable of other embodiments and implementations and is thus capable of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present disclosure. It is important, therefore, that the claims be regarded as including such equivalent constructions insofar as they do not depart from the spirit and scope of the present disclosure.

The advantages of the various embodiments of the present disclosure, along with the various features of novelty that characterize the disclosure, are disclosed in the following descriptive matter and accompanying drawings.

BRIEF DESCRIPTION OF THE DRAWINGS

The disclosure will be better understood and when consideration is given to the drawings and the detailed description which follows. Such description makes reference to the annexed drawings wherein.

DETAILED DESCRIPTION

Figure 1:
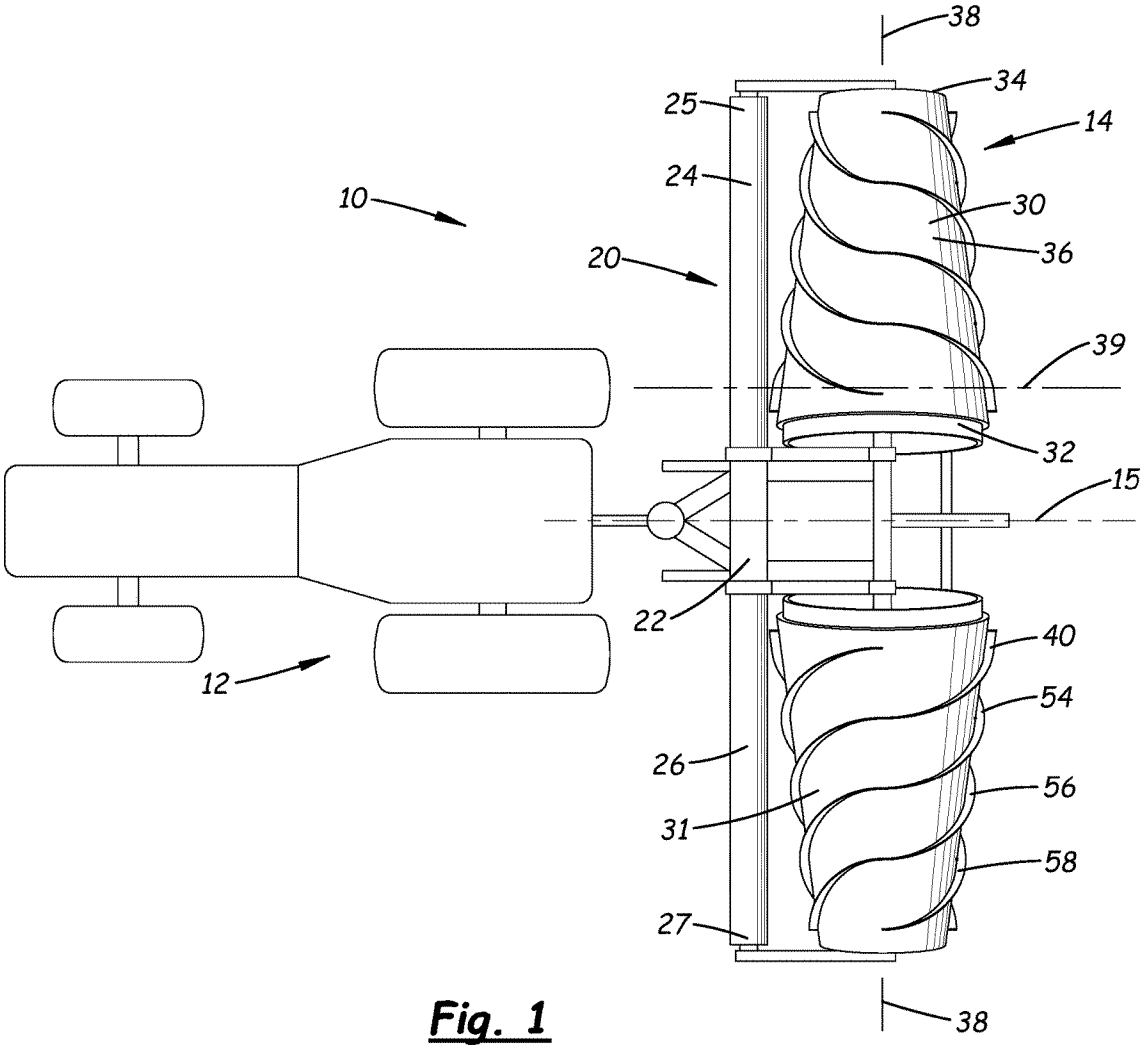
FIG. 1 is a schematic top view of a new system including a ground contouring apparatus according to the present disclosure.
Figure 2:
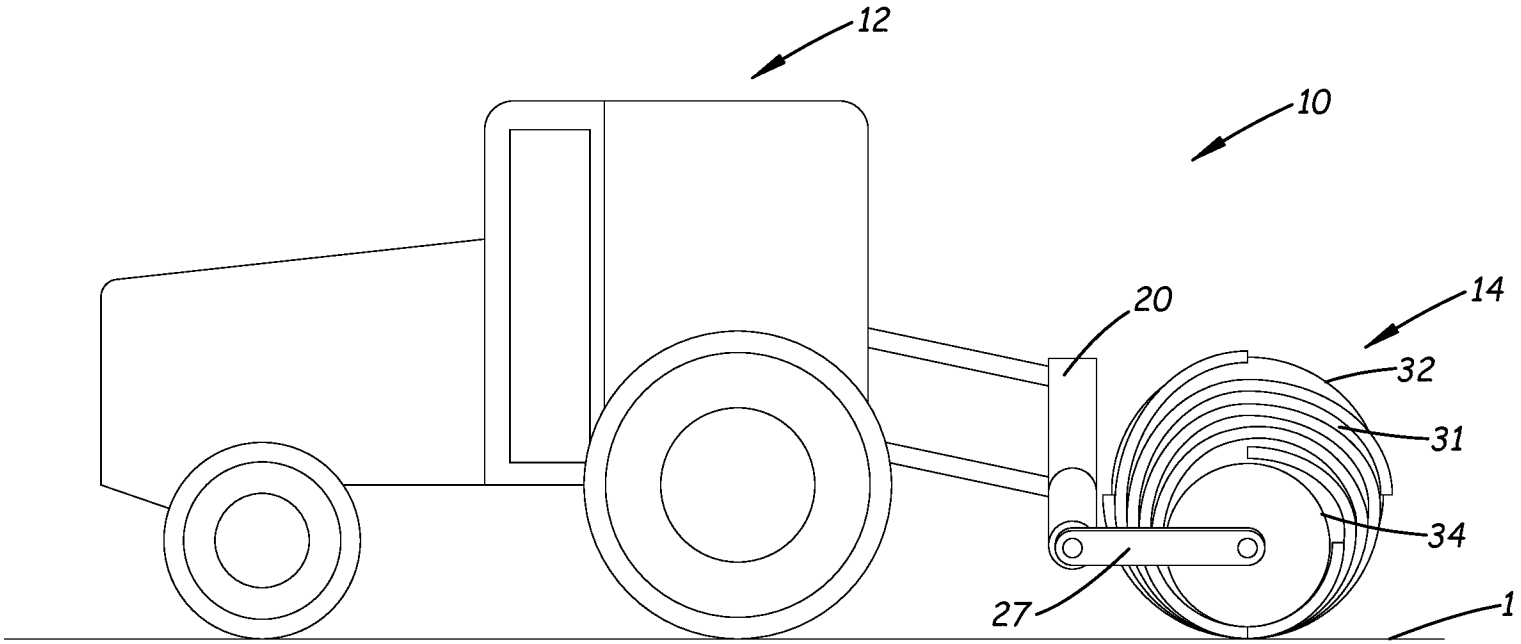
FIG. 2 is a schematic side view of the system, according to an illustrative embodiment.
Figure 3:
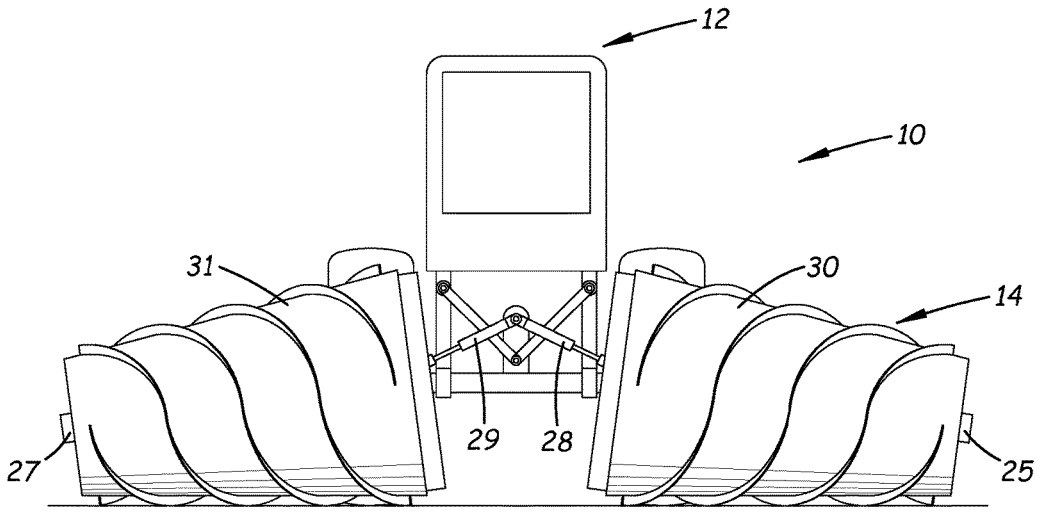
FIG. 3 is a schematic rear view of the system, according to an illustrative embodiment.
Figure 4:
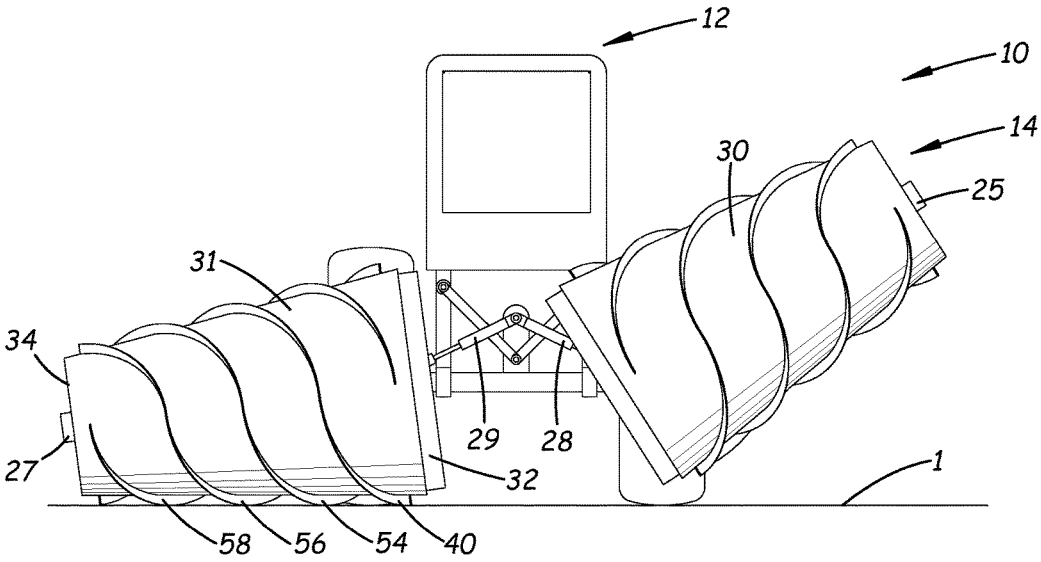
FIG. 4 is a schematic rear view of the system with one of the drums raised, according to an illustrative embodiment.
Figure 5:
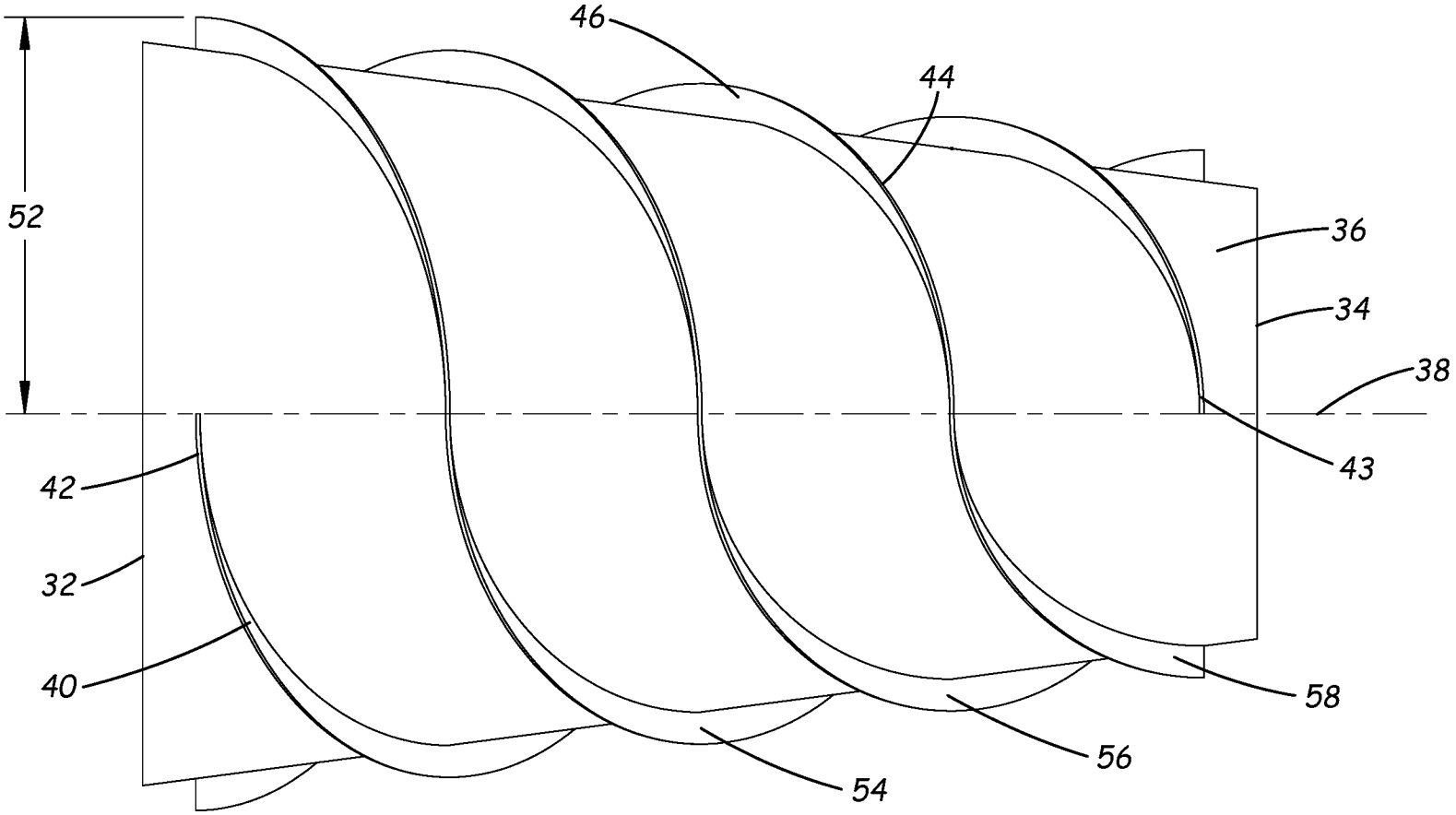
FIG. 5 is a schematic front view of the drum of the apparatus, according to an illustrative embodiment.

With reference now to the drawings, and in particular to FIGS. 1 through 6 thereof, a new ground contouring apparatus embodying the principles and concepts of the disclosed subject matter will be described.

The disclosure generally relates to a system 10 for contouring or reshaping a ground surface 1, which for the purposes of this description will be described as a road surface, but may be any ground surface generally having loose particles or particulate material forming the surface, such as gravel or small rock in the case of a road surface or even soil in the case of an agricultural field or construction site. The apparatus may have the ability to move the particles in a direction lateral or transverse to the direction of travel or movement of the apparatus, and may move material in either lateral direction which may permit the apparatus to move material toward or away from a centerline of the apparatus in the direction of travel of the apparatus. The apparatus may also have the ability to loosen particles from a compacted condition on the surface, such that looseness of the particles is not a requisite for effective use of the system. In the case of road surfaces, movement of loose material such as gravel from the peripheral edges of the road toward the centerline of the road is useful for maintaining the condition of the road and for reversing the typical movement of the particles away from the centerline.

In some aspects, the disclosure relates to a system 10 that includes a vehicle 12, which may be a tractor or other vehicle capable of pulling or towing an apparatus of the type described herein. An agricultural field tractor is one example of a suitable vehicle, but other agricultural or earth moving vehicles may be utilized as well, such as, for example, a motor grader or motor-patrol.

The system 10 may include an apparatus 14 for grading or moving about the ground surface particulate material that forms the ground surface, such as gravel or soil, and it should be recognized that the scope of the invention may or may not include the aforementioned vehicle. The apparatus 14 may be configured for being removably connected to the vehicle for being towed behind the vehicle, although it is conceivable that the apparatus 14 may be integrated with or into a vehicle. As a point of reference, the apparatus 14 may have a center line 15 which generally corresponds to the axis along which the apparatus 14 is towed by the vehicle during forward movement of the vehicle.

The apparatus 14 may include a frame 20 which may extend generally rearwardly from a vehicle when the apparatus is being towed by the vehicle and the frame may also extend generally laterally with respect to the center line 15. The frame 20 may include a central frame portion 27 which is generally positioned on the center line 15 and may include a tongue structure 24 for removably connecting to a vehicle to permit towing of the apparatus 14.

The frame 20 may also include lateral frame portions 24, 26 which are positioned on either side of the central frame portion 22. The lateral frame portions may extend laterally outwardly from the central frame portion, and may be oriented substantially transverse or perpendicular to the center line 15. The lateral frame portions may be movably mounted on the central frame portion, and in some embodiments the portions may be pivotally mounted on the central frame portion. The frame portions 24, 26 may have respective opposite outside ends 25, 27. The frame 20 may also include a lift device configured to selectively raise the outside end of at least one of the lateral frame portions, and this movement may be produced by pivoting one or both of the lateral frame portions with respect to the central frame portion. The lift device may be mounted on the central frame portion and on the lateral frame portions and may include actuators 28, 29 connected between the central frame portion and the respective lateral frame portions. Illustratively, the actuator 28, 29 may comprise a hydraulic piston and cylinder which is provided with a supply of a hydraulic fluid by a hydraulic fluid circuit having a control permitting hydraulic fluid flow to the hydraulic piston and cylinder in order to cause lengthening and shortening of the effective length of the actuator which in turn results in raising and lowering of the lateral frame portion to which it is connected.

Figure 6:
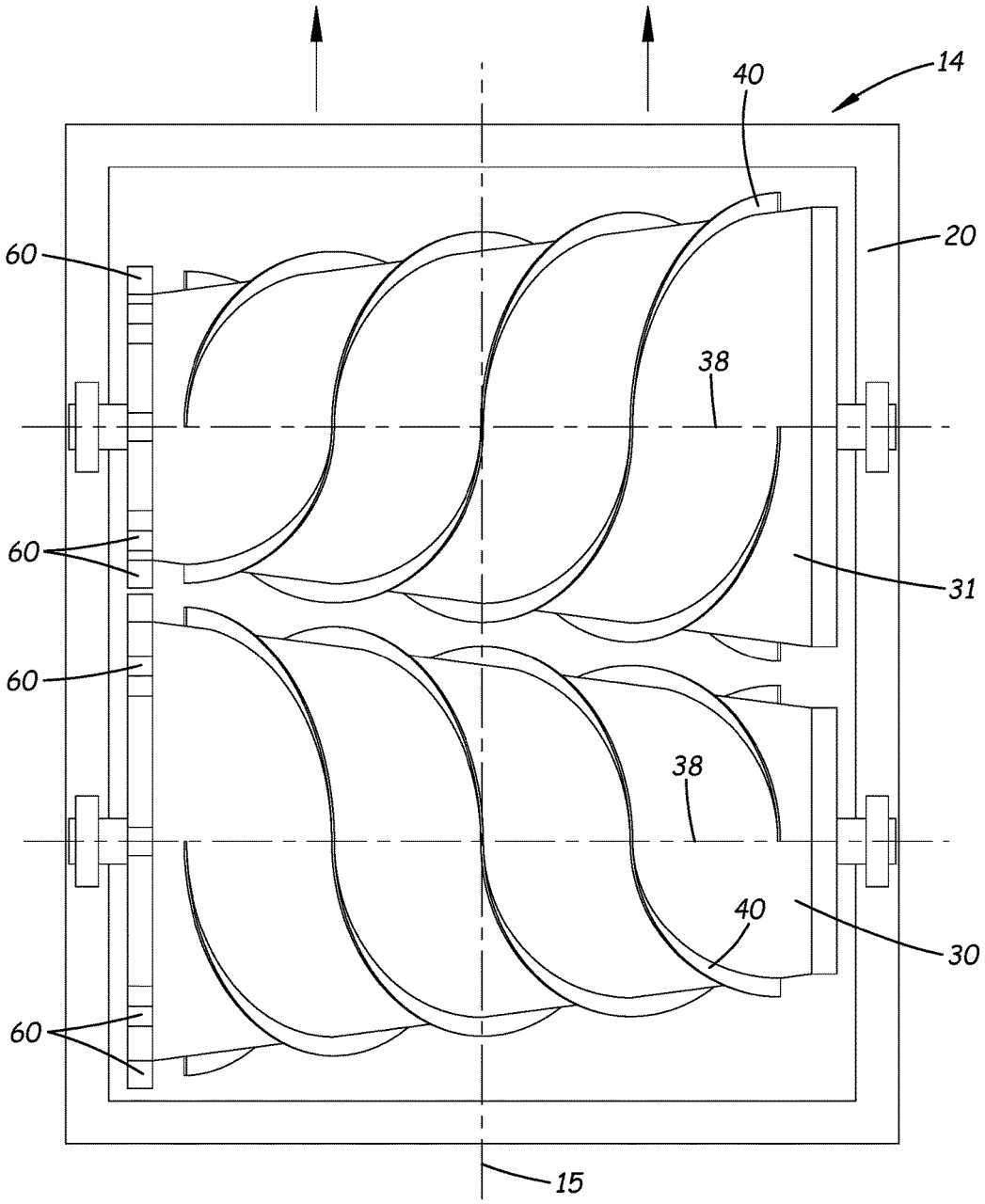
FIG. 6 is a schematic top view of an embodiment of the system in which the drums of the ground contouring apparatus has drums positioned in a longitudinal arrangement.

The apparatus 14 may further include at least one drum 30 which is configured to contact the ground surface and in some embodiments, the apparatus 14 includes a pair of drums 30, 31. The drums 30, 31 may be positioned on the frame 20 to extend in substantially opposite lateral directions from the center line 15, such as is shown in FIGS. 1 through 4, which permits each drum to engage one of the lanes of a two lane road simultaneously in a single pass. The drums 30, 31 may also be positioned longitudinally with respect to the center line, such that one drum is positioned forward and one is positioned rearward, such as is shown in FIG. 6, which permits both drums to simultaneously engage a single lane of a road in a pass. The drum 30 may be rotatably mounted on the frame 20 and may be mounted in such a manner that it is able to freely rotate with respect to the frame such that movement of the apparatus 14 over the ground surface causes the drum to rotate with respect to the frame. The drum may have opposite ends 32, 34, with an end closest to the center line 15 being an inboard end 32 and an end located relatively further from the center line being an outboard end 34. The drum 30 may be mounted on the frame 20 at the inboard and outboard ends by suitable structures such as bearings or bushings to permit substantially free rotation of the drum with respect to the frame. Typically, although not necessarily, the actuators of the lift device are not configured to press the drum or drums downwardly against the ground surface such that the weight of the drum provides substantially the entire downforce on the drum against the ground surface.

The drum 30 may also have an outer surface 36 which may be substantially smooth in character and may also be substantially continuous between the ends 32, 34. The drum 30 may have a central longitudinal axis 38 which extends from the inboard end to the outboard end and may also correspond to the rotational axis about which the drum rotates with respect to the frame, and in embodiments utilizing two drums, the respective central longitudinal axes 38 of the drums may be aligned in at least a vertically oriented plane.

The outer surface 36 of the drum may be substantially circular in a plane 39 which is oriented perpendicular to the central longitudinal axis 38. The outer surface of the drum may be characterized by a diameter which is measured in the plane 39 and may also have an outer circumference also lying in the plane 39. In some embodiments, the diameter of the outer surface 36 of the drum or drums may taper smaller towards the outboard end 34, and may taper substantially continuously from the inboard end 32 to the outboard end 34. The diameter of the outer surface may taper substantially uniformly from the inboard to outboard end such that the outer surface 36 is substantially frusta-conical similar to a truncated cone.

The drum or drums 30, 31 may each have at least one blade 40 which extends from the drum. The blade 40 may protrude outwardly from the outer surface 36 of the drum, and may protrude radially outwardly with respect to the outer surface. The blade 40 may extend substantially continuously between an inner end 42 of the blade and an outer end 43 of the blade. The inner end 42 of the blade may be located toward the inboard end 32 of the drum, while the outer end 43 may be located toward the outboard end 34 of the drum.

The blade 40 may have an outer edge 44 and may also have an inner edge 46 located opposite of the outer edge 44. The inner edge 46 may be united to the drum, such as by welding of the blade to the outer surface of the drum. The height of the blade may be defined between the inner 46 and outer 44 edges and the height may be substantially uniform between the inner 42 and outer 43 ends of the blade, although some variation in the height may be employed. The outer edge of the blade may have a radius 52 which may be measured in the plane 39 which is oriented substantially perpendicular to the central longitudinal axis of the drum. The outer edge 44 may be substantially smooth and continuous without interruption between the inner 42 and outer 43 ends of the blade.

The drums 30, 31 may include at least two blades 40, 54 and the illustrative embodiment includes four blades 40, 54, 56, 58. In drums with multiple blades, each of the blades may be substantially equally spaced from an adjacent blade on the drum. The greater the number of blades employed on the drum, the greater the amount of particles on the ground surface can be contacted and moved by the apparatus, although numbers of blades greater than, for example, approximately six appear to shown diminishing benefit as the angle of the blade with respect to the direction of movement tends to become larger.

The outer edge 44 of the blade 40 may have a helical shape and the blade 40 may extend along the outer surface 36 of the drum in a substantially helical path, which may be characterized as concho-helical. Each of the blades employed on the drum, such as blades 40, 54, 56, 58, may be helical in shape along the outer surface. In some embodiments, the direction or chirality of the helical wind of the blade or blades on the drum is such that at the inner end 42 of the blade, the blade appears to extend downwardly and outwardly when viewed from a perspective in front of the apparatus (e.g., from a point toward which the drum is advancing as the apparatus is being moved across the surface). As illustrated in the drawings, the apparent direction in which the helical blade is wound about the surface of the drum is different between the two drums positioned on opposite sides of the central frame portion, with one having a clockwise wrap and the other having a counter clockwise wrap. The difference in direction of the helical blade can simply be achieved by rotating the orientation of substantially the same drum design by 180 degrees.

The radius 52 of the outer edge 44 of the blade 40 may be less at the outboard end 34 of the drum than the radius of the outer edge at the inboard end 32 of the drum. The radius of the outer edge may taper smaller from the inboard 32 to the outboard 34 ends of the drum (and from the corresponding inner end 42 to the outer end 43 of the blade) in a substantially uniform manner or configuration. In the illustrative embodiments, the tapering of the radius of the outer edge is accomplished by mounting a blade 40 with a substantially uniform height to the outer surface of a drum having a decreasing or tapering smaller radius, although other techniques for providing a decreasing outer edge radius may be utilized. The shape of the outer edge of the blade may be characterized as a conic helix to reflect the helical and conical aspects of the shape.

In some embodiments, the blade 40 or blades may be formed of a material different from the material forming the drum, and the blade may be formed of a separate piece or part of material that is attached or fastened to the drum. Illustratively, the drum mat be formed of a sheet material, such as sheet metal, and the blades may be formed of a cast metal, such as cast iron, to provide relatively greater strength and rigidity in the blades which may be exposed to greater stresses than the wall of the drum.

In use, moving the drum across the ground surface tends to cause the free-rotating drum to rotate at a speed that is dependent upon the speed at which the apparatus moves across the surface, and does not utilize or require assistance in the rotation of the drum at a speed that is not reliant upon the ground speed at which the apparatus is moved across the surface. The rotation of the drum or drums across a surface that has loose particles on the surface (or which forming the "surface"), tends to loosen particles on (or forming) the uppermost layer of the surface (to the extent that the top layer of particles are not already loosened and not embedded in the surface), and displace or move the particles laterally with respect to the longitudinal axis of the road. By virtue of the geometric difference in diameter or circumference between the ends of the truncated cone of the outer edges of the blades of the drum, a force is exerted on the particles on the surface that is generally counter to the direction in which the drum is rolling on the surface (e.g., rolling in a direction that normal to the central longitudinal axis of the drum). The blades tend to displace or move the material laterally inwardly toward the center of the road, and toward the central frame portion of the apparatus.

In use of the apparatus 10, the centerline 15 of the apparatus may be aligned with and generally positioned above the line of the crown of the surface of the road. The rolling contact between the apparatus and the ground surface tends to have the effect of displacing a measured volume of the particles on the ground surface (such as gravel on a road surface) toward the central frame portion (and thus toward a center line of a road surface) to create or enhance the crown of the road surface to, for example, promote drainage of water from the surface of the road. The action of the blade or blades on the surface thus tends to displace or move a portion of the particles on the surface near or at the shoulder toward the center or crown of the road. Further, the rolling contact of the apparatus with the road surface may form or cut grooves in the road surface which extend toward the shoulder of the road for water to evacuate the road surface but may leave a large proportion of vegetation intact. Further, the contact with the road surface may pack the surface in a form that conforms to the shape of the cone such as a straight inclined line. Also, the spiral contour of the blades attached to the conically-shaped drum rolled in the described motion tends to cut and pack the surface particles in an alignment at large angle to any washboard lines in the surface which tends to break the resonance of the washboard to therefore diminish the presence of the washboard contour in the road surface. During use of the apparatus on a road surface, the particles tend to be packed and small rills tend to be cut diagonally outward from the center of the road to allow evacuation of surface water from the road surface.

It should be recognized that embodiments utilizing a pair of the drums may be suitably arranged to counter the reaction forces that act in the direction of the central longitudinal axis of the drums as a result of the interaction of the blades on the drum with the ground surface. The forces may be balanced, or countered by each other, by the lateral arrangement of the drums shown in FIGS. 1 through 4 in which the blades on the drums have a twist in opposite directions with one drum having a left hand twist and the other drum having a right hand twist. The orientation of the taper of the drums may be opposite of each other. Optionally, the forces may be balanced, or countered by each other, by the longitudinal arrangement of the drums shown in FIG. 6 in which the blades on the drums also have a twist in opposite directions with one drum having a left hand twist and the other drum having a right hand twist. Such as longitudinal configuration may provide greater ease of use in that only one side or lane of the road being surfaced is potentially obstructed by the apparatus at one time. The orientation of the taper of the drums may also be opposite of each other in such longitudinal arrangements.

Optionally, a plurality of traction members 60 may be positioned on the exterior of the drums (see FIG. 6) to facilitate the rotation of the drums as the apparatus is being moved across the ground surface. The traction members 60 may be spaced along the circumference of the drum, and may be substantially equidistantly spaced with a sufficient number of the traction members 60 such that at least one of the members 60 is in contact with the ground surface at any rotational orientation of the drum with respect to the ground surface. The traction members may be positioned along an end of the drum, and may be positioned in a plane that is oriented perpendicular to the central longitudinal axis 38 of the drum. The traction members 60 may be positioned at either end of the drum, and may most usefully positioned at the end of the drum that is to be operated closer to the centerline or crown of the road.

In an illustrative embodiment of the apparatus, the drum may have a length between ends of approximately 10 feet, which is highly suitable for the width of a typical road surface (e.g., for contacting one half of the road surface from the crown to the shoulder) although other widths could be used. An illustrative weight of one of the drums with supporting structure may be approximately one to approximately three tons (approximately 2000 pounds to approximately 6000 pounds) to achieve a suitable degree of downward pressure from the blades to the ground surface.

It should be appreciated that in the foregoing description and appended claims, that the terms "substantially" and "approximately," when used to modify another term, mean "for the most part" or "being largely but not wholly or completely that which is specified" by the modified term.

It should also be appreciated from the foregoing description that, except when mutually exclusive, the features of the various embodiments described herein may be combined with features of other embodiments as desired while remaining within the intended scope of the disclosure.

Further, those skilled in the art will appreciate that the steps shown in the drawing figures may be altered in a variety of ways. For example, the order of the steps may be rearranged, substeps may be performed in parallel, shown steps may be omitted, or other steps may be included, etc.

With respect to the above description then, it is to be realized that the optimum dimensional relationships for the parts of the disclosed embodiments and implementations, to include variations in size, materials, shape, form, function and manner of operation, assembly and use, are deemed readily apparent and obvious to one skilled in the art in light of the foregoing disclosure, and all equivalent relationships to those illustrated in the drawings and described in the specification are intended to be encompassed by the present disclosure.

Therefore, the foregoing is considered as illustrative only of the principles of the disclosure. Further, since numerous modifications and changes will readily occur to those skilled in the art, it is not desired to limit the disclosed subject matter to the exact construction and operation shown and described, and accordingly, all suitable modifications and equivalents may be resorted to that fall within the scope of the claims.

I claim:

1. An apparatus for contouring particulate material on a ground surface, the apparatus having a centerline corresponding to an axis along which the apparatus is moved for contouring, the apparatus comprising:

a frame extending laterally with respect to the centerline;

at least one drum rotatably mounted on the frame such that the drum rotates with respect to the frame about a central longitudinal axis of the drum, the at least one drum having opposite inboard and outboard ends and an outer surface therebetween;

at least two blades extending about the drum and protruding outwardly from the outer surface of the drum, the at least two blades each having an outer edge with a radius measured from the central longitudinal axis in a plane oriented in perpendicular to the central longitudinal axis of the drum to the outer edge;

a plurality of traction members associated with the at least one drum, the traction members extending radially outwardly from the drum to engage the ground surface upon which the apparatus rests to cause rotation of the drum when the frame is moved with respect to the ground surface, the plurality of traction member being arranged in a circumferential circle along one said end of the drum, the traction members being spaced from the at least two blades;

wherein the outer edges of the at least two blades each have a helical shape and the radius of the outer edge at the outboard end of the drum is less than the radius of the outer edge at the inboard end of the drum; and wherein the outer edges of all of the blades extend substantially parallel to each other in the helical shape to move the particulate material longitudinally with respect to the drum;

wherein the drum is freely rotatable with respect to the frame such that contact between the apparatus and the ground surface as the frame is moved with respect to the ground surface causes the drum to rotate at a speed substantially corresponding to a speed of movement of the frame with respect to the ground surface.

2. The apparatus of claim 1 wherein the outer edges of the at least two blades are substantially continuous between the inboard and outboard ends of the at least one drum; and wherein the radius of the outer edge of the at least two blades each taper substantially uniformly smaller from one of the ends of the drum to an other one of the ends of the drum.

3. The apparatus of claim 1 wherein the outer surface of the at least one drum has a diameter and the diameter of the outer surface of the drum is less at the outboard end of the drum than the diameter of the outer surface at the inboard end of the drum.

4. The apparatus of claim 3 wherein the diameter of the outer surface of the drum tapers smaller substantially continuously from the inboard end of the drum to the outboard end of the drum.

5. The apparatus of claim 1 wherein the at least one drum comprises a pair of drums extending in substantially opposite lateral directions with respect to the centerline of the apparatus.

6. The apparatus of claim 5 wherein the frame includes a central frame portion and a pair of lateral frame portions extending laterally from the central frame portion, the frame portions having opposite outside ends and being pivotally mounted on the central frame, each of the drums being mounted on one of the lateral frame portions;

wherein the frame additionally comprises a lift device mounted on the central frame portion and at least one of the lateral frame portions to selectively raise the outside end of that at least one lateral frame portion to thereby raise a portion of a said drum mounted on the at least one lateral frame portion.

7. The apparatus of claim 1 wherein all of the at least two blades have a helical shape.

8. The apparatus of claim 1 wherein the plurality of traction members is located on the inboard end of the drum.

9. The apparatus of claim 1 wherein inner ends of each of the at least two blades are located toward the inboard end of the drum and outer ends of each of the at least two blades are located toward the outboard end of the drum, the at least one blade extending substantially continuously between the inner end and the outer end.

10. The apparatus of claim 1 wherein the outer surface of the at least one drum is substantially continuous between the inboard and outboard ends of the drum.

11. An apparatus for contouring particulate material on a ground surface, the apparatus having a centerline corresponding to an axis along which the apparatus is moved for contouring, the apparatus comprising:

a frame extending laterally with respect to the centerline;

at least one drum rotatably mounted on the frame such that the drum rotates substantially freely with respect to the frame about a central longitudinal axis of the drum, the at least one drum having opposite inboard and outboard ends and an outer surface therebetween;

at least two blades extending about the drum and protruding outwardly from the outer surface of the drum, the at least two blades each having an outer edge with a radius measured from the central longitudinal axis in a plane oriented in perpendicular to the central longitudinal axis of the drum to the outer edge;

wherein the outer edges of the at least two blades each have a helical shape and the radius of the outer edge is less at the outboard end of the drum than the radius of the outer edge at the inboard end of the drum;

wherein the outer edges of all of the blades extend substantially parallel to each other in the helical shape to move the particulate material longitudinally with respect to the drum;

wherein the outer edges of the at least two blades each extend continuously from the inboard and of the at least one drum to the outboard end of the at least one drum;

wherein the radius of the outer edge of the at least two blades each tapers substantially uniformly smaller from one of the ends of the drum to an other one of the ends of the drum;

wherein all of the at least two blades have a helical shape;

wherein inner ends of each of the at least two blades are located toward the inboard end of the drum and outer ends of each of the at least two blades are located toward the outboard end of the drum, the at least one blade extending substantially continuously between the inner end and the outer end;

wherein the outer surface of the at least one drum has a diameter and the diameter of the outer surface of the drum is less at the outboard end of the drum than the diameter of the outer surface at the inboard end of the drum;

wherein the diameter of the outer surface of the at least one drum tapers smaller substantially continuously from the inboard end of the drum to the outboard end of the drum;

wherein the outer surface of the at least one drum is substantially continuous between the inboard and outboard ends of the drum.

wherein the at least one drum comprises a pair of drums extending in substantially opposite lateral directions with respect to the centerline of the apparatus;

wherein the frame includes a central frame portion and a pair of lateral frame portions extending laterally from the central frame portion, the frame portions having opposite outside ends and being pivotally mounted on the central frame, each of the drums being mounted on one of the lateral frame portions; and wherein the frame additionally comprises a lift device mounted on the central frame portion and at least one of the lateral frame portions to selectively raise the outside end of that at least one lateral frame portion to thereby raise a portion of a said drum mounted on the at least one lateral frame portion.

12. A system for contouring a road surface, the system comprising:

an apparatus for contouring particulate material on the road surface, the apparatus having a centerline corresponding to an axis along which the apparatus is moved for contouring, the apparatus comprising:

a frame extending laterally with respect to the centerline;

a blade assembly rotatably mounted on the frame such that the blade assembly rotates with respect to the frame about a central longitudinal axis, the blade assembly including at least two blades each having an inner end relatively closer to the centerline and an outer end relatively further from the centerline, the at least two blades each having an outer edge with a radius measured from the central longitudinal axis in a plane oriented perpendicular to the central longitudinal axis to the outer edge;

a plurality of traction members associated with the blade assembly, the traction members extending radially outwardly with respect to the central longitudinal axis to engage the ground surface upon which the apparatus rests to cause rotation of the blade assembly when the frame is moved with respect to the ground surface, the plurality of traction member being arranged in a circumferential circle along one said end of the blades of the blade assembly, the traction members being spaced from the at least two blades;

wherein the outer edges of the at least two blades each have a helical shape and the radius of the outer edge at the outer end of the blade is less than the radius of the outer edge at the inner end of the blade;

wherein the outer edges of all of the blades extend substantially parallel to each other in the helical shape to move the particulate material in a longitudinal direction substantially parallel to the central longitudinal axis of the blade assembly:

wherein the blade assembly is freely rotatable with respect to the frame such that contact between the apparatus and the ground surface as the frame is moved with respect to the ground surface passively causes the blade assembly to rotate at a speed substantially corresponding to a speed of movement of the frame with respect to the ground surface.

13. The system of claim 12 wherein the plurality of traction members is located on the inner end of the drum.

14. The system of claim 12 wherein the outer edges of the at least two blades are substantially continuous between the inner and outer ends of the at least two blades; and wherein the radius of the outer edge of each blade tapers substantially uniformly smaller from the inner end of the blade to the outer end of the blade.

15. The system of claim 12 wherein the apparatus additionally includes at least one drum rotatably mounted on the frame such that the drum rotates with respect to the frame about a central longitudinal axis of the drum, the at least one drum having opposite inboard and outboard ends and an outer surface therebetween, the at least two blades of the blade assembly being mounted on the at least one drum.

16. The system of claim 15 wherein the outer surface of the at least one drum is substantially conical with a diameter, and the diameter of the outer surface of the drum is less at the outboard end of the drum than the diameter of the outer surface at the inboard end of the drum.

17. The system of claim 15 wherein the diameter of the outer surface of the at least one drum tapers smaller substantially continuously from the inboard end of the drum to the outboard end of the drum.

18. The system of claim 12 wherein the frame includes a central frame portion and a pair of lateral frame portions extending laterally from the central frame portion, the frame portions having opposite outside ends and being pivotally mounted on the central frame;

wherein the apparatus includes a pair of the blade assemblies, each of the blade assemblies being mounted on one of the lateral frame portions; and wherein the frame additionally comprises a lift device mounted on the central frame portion and at least one of the lateral frame portions to selectively raise the outside end of that at least one lateral frame portion to thereby raise a portion of a said blade assembly mounted on the at least one lateral frame portion.

19. The system of claim 12 additionally comprising a vehicle, the apparatus being removably hitched to the vehicle such that movement of the vehicle across the road surface produces corresponding movement of the apparatus across the road surface.

20. The system of claim 19 wherein the plurality of traction members is located on the inner end of the drum;

wherein the outer edges of the at least two blades are substantially continuous between the inner and outer ends of the at least two blades;

wherein the radius of the outer edge of each blade tapers substantially uniformly smaller from the inner end of the blade to the outer end of the blade;

wherein the frame includes a central frame portion and a pair of lateral frame portions extending laterally from the central frame portion, the frame portions having opposite outside ends and being pivotally mounted on the central frame;

wherein the apparatus includes a pair of the blade assemblies, each of the blade assemblies being mounted on one of the lateral frame portions; and wherein the frame additionally comprises a lift device mounted on the central frame portion and at least one of the lateral frame portions to selectively raise the outside end of that at least one lateral frame portion to thereby raise a portion of a said blade assembly mounted on the at least one lateral frame portion.

* * * * *